US010709198B2

(12) United States Patent
Ito et al.

(10) Patent No.: US 10,709,198 B2
(45) Date of Patent: Jul. 14, 2020

(54) SOLE STRUCTURE AND SHOE INCLUDING SAME

(71) Applicant: MIZUNO CORPORATION, Osaka (JP)

(72) Inventors: Kouji Ito, Osaka (JP); Shin Hirai, Osaka (JP)

(73) Assignee: Mizuno Corporation, Osaka (JP)

( * ) Notice: Subject to any disclaimer, the term of this patent is extended or adjusted under 35 U.S.C. 154(b) by 7 days.

(21) Appl. No.: 16/292,528

(22) Filed: Mar. 5, 2019

(65) Prior Publication Data

US 2019/0281922 A1 Sep. 19, 2019

(30) Foreign Application Priority Data

Mar. 14, 2018 (JP) ..... 2018-046729

(51) Int. Cl.

| | |
|---|---|
| ***A43B 3/26*** | (2006.01) |
| ***A43B 13/12*** | (2006.01) |
| ***A43B 13/14*** | (2006.01) |
| ***A43B 7/14*** | (2006.01) |
| ***A43B 13/04*** | (2006.01) |
| ***A43B 13/18*** | (2006.01) |
| ***A43B 3/24*** | (2006.01) |

(52) U.S. Cl.

CPC ..... *A43B 13/127* (2013.01); *A43B 3/24* (2013.01); *A43B 3/248* (2013.01); *A43B 3/26* (2013.01); *A43B 7/1425* (2013.01); *A43B 13/04* (2013.01); *A43B 13/146* (2013.01); *A43B 13/187* (2013.01)

(58) Field of Classification Search

CPC ..... A43B 3/26; A43B 3/24; A43B 3/248

USPC ..... 36/97

See application file for complete search history.

(56) References Cited

U.S. PATENT DOCUMENTS

| | | | | |
|---|---|---|---|---|
| 3,541,708 | A * | 11/1970 | Rosen | A43B 3/26 36/97 |
| 3,686,777 | A * | 8/1972 | Rosen | A43B 3/26 36/97 |
| 5,729,912 | A * | 3/1998 | Gutkowski | A43B 3/26 36/93 |
| 6,138,385 | A * | 10/2000 | Jungkind | A43B 1/0018 36/102 |
| 2002/0088145 | A1* | 7/2002 | Clark | A43B 13/181 36/97 |
| 2006/0162191 | A1* | 7/2006 | Mason | A43B 3/26 36/97 |
| 2008/0244929 | A1* | 10/2008 | Garcia-Perez Aradros | A43B 1/0018 36/88 |
| 2010/0175277 | A1* | 7/2010 | Langvin | A43D 5/00 36/97 |
| 2011/0047826 | A1* | 3/2011 | Rosen | A43B 23/07 36/97 |

(Continued)

*Primary Examiner* — Marie D Bays

(74) *Attorney, Agent, or Firm* — Troutman Sanders LLP; James E. Schutz; Micah B. Hensley

(57) ABSTRACT

A sole body has an upper midsole made of an elastic material, staked over an upper side of a lower midsole, and having, on an upper surface thereof, a planta support surface. The upper midsole has a first recess recessed from the planta support surface in a downward direction and having a bottom, and a second recess recessed from a lower surface of the upper midsole toward the planta support surface, and having a bottom. The first and second recesses are alternately and continuously formed in the width direction of the foot.

4 Claims, 12 Drawing Sheets

(56) References Cited

U.S. PATENT DOCUMENTS

| | | | | |
|---|---|---|---|---|
| 2017/0188655 | A1* | 7/2017 | Carlson | A63C 17/00 |
| 2019/0281920 | A1* | 9/2019 | Ito | A43B 3/26 |

* cited by examiner

SOLE STRUCTURE AND SHOE INCLUDING SAME

CROSS-REFERENCE TO RELATED APPLICATION

This application claims priority to Japanese Patent Application No. 2018-046729 filed on Mar. 14, 2018, the entire disclosure of which is incorporated by reference herein.

BACKGROUND

The present disclosure relates to a sole structure and a shoe including such a sole structure.

A shoe sole structure of which a length of the sole body in the foot width direction is adjustable by an adjustment mechanism has been known. For example, U.S. Patent Application Publication No. 2017/0188655 proposes a sole structure of this type.

This patent document discloses a sole structure for a shoe, the sole structure including a sole body including upper and lower midsoles, and the adjustment mechanism provided between the upper and lower midsole and capable of adjusting the length of the sole body in the foot width direction of the sole body. In the upper midsole, a plurality of slots extend in the longitudinal direction and pass through the upper midsole in the thickness direction. The slots are arranged at intervals in the foot width direction of the sole body.

SUMMARY

In the sole structure of U.S. Patent Application Publication No. 2017/0188655, foreign objects are likely to be introduced through the slots, which pass through the upper midsole in the thickness direction, toward the planta support surface of the upper midsole.

Further, when the length of the sole body in the foot width direction is changed with the adjustment mechanism, adjustment of the length of the sole body in the foot width direction merely changes the intervals between the slots arranged in the foot width direction, and a solid portion of the upper midsole, where no slots are formed, is less likely to transform in the foot width direction. As a result, in the case of the above adjustment, a resistance generated when the adjustment mechanism is in motion with respect to the foot width direction is generated at least in the upper midsole. As can be seen, in the sole structure of U.S. Patent Application Publication No. 2017/0188655, it is difficult to smoothly adjust the length of the sole body in the foot width direction with the adjustment mechanism.

In view of the foregoing background, the present disclosure attempts to reduce the risk of foreign objects entering a sole body and to enable smooth adjustment of the length of the sole body in the foot width direction with an adjustment mechanism.

A first aspect of the present disclosure is directed to a sole structure of a shoe. The sole structure includes a sole body; and an adjustment mechanism provided in an intermediate portion of the sole body in a thickness direction, and capable of adjusting a length of the sole body in a foot width direction, wherein the sole body includes: an outsole; a lower midsole made of an elastic material and stacked above the outsole; and an upper midsole made of an elastic material, staked above the lower midsole, and having, on an upper surface thereof, a planta support surface supporting a planta of a wearer. The upper midsole includes: a first recess recessed from the planta support surface in a downward direction and having a bottom, and a second recess recessed from a lower surface of the upper midsole toward the planta support surface, and having a bottom. The first and second recesses are alternately and continuously formed in the foot width direction.

In the first aspect, each of the first and second recesses in the upper midsole has a bottom. This feature makes it possible to reduce the risk of foreign objects coming from the outsole toward the planta support surface of the upper midsole. The first and second recesses that are alternately and continuously formed in the foot width direction easily stretch and contract in the foot width direction. As a result, a resistance is less likely to be generated by the adjustment mechanism at least in the upper midsole when the length of the sole body in the foot width direction is adjusted is by the adjustment mechanism. Thus, the first aspect can reduce or prevent entry of foreign objects into the sole body, and allows smooth adjustment of the length of the sole body in the foot width direction by the adjustment mechanism.

A second aspect of the present disclosure is an embodiment of the first embodiment. In the second aspect, the first recess may have a micro opening to the planta support surface.

In this respect, the sole structure of U.S. Patent Application Publication No. 2017/0188655, the openings of the slots extending in the longitudinal direction appear on the planta support surface. Therefore, when the edges of the openings of the slots come into contact with the planta of the wearer, a local stimulus is likely to be given to the planta of the wearer's foot. As a result, the sole structure of U.S. Patent Application Publication No. 2017/0188655 may give discomfort to the planta of the wearer's foot. In contrast, according to the second aspect, the first recess has a micro opening that appears on the side of the planta support surface. Therefore, even if the first recess comes into contact with planta of the wearer's foot, the wearer does not feel the presence of the recess, which has the micro opening, reducing a local stimulus to the planta. Thus, the second aspect can reduce discomfort to the planta of the wearer's foot.

A third aspect of the present disclosure is directed to a shoe including the sole structure of any one of the first and second aspects.

In the third aspect, the shoe can be provided with the same effects as those of the first or second aspect.

As described above, the present disclosure makes it possible to reduce or prevent entry of foreign objects into the sole body, and allows smooth adjustment of the length of the sole body in the foot width direction by the adjustment mechanism.

DETAILED DESCRIPTION

Embodiments of the present disclosure will be described in detail with reference to the drawings. Note that the following description of the embodiment is merely an example in nature, and is not intended to limit the scope, applications, or use of the present disclosure.

Figure 1:
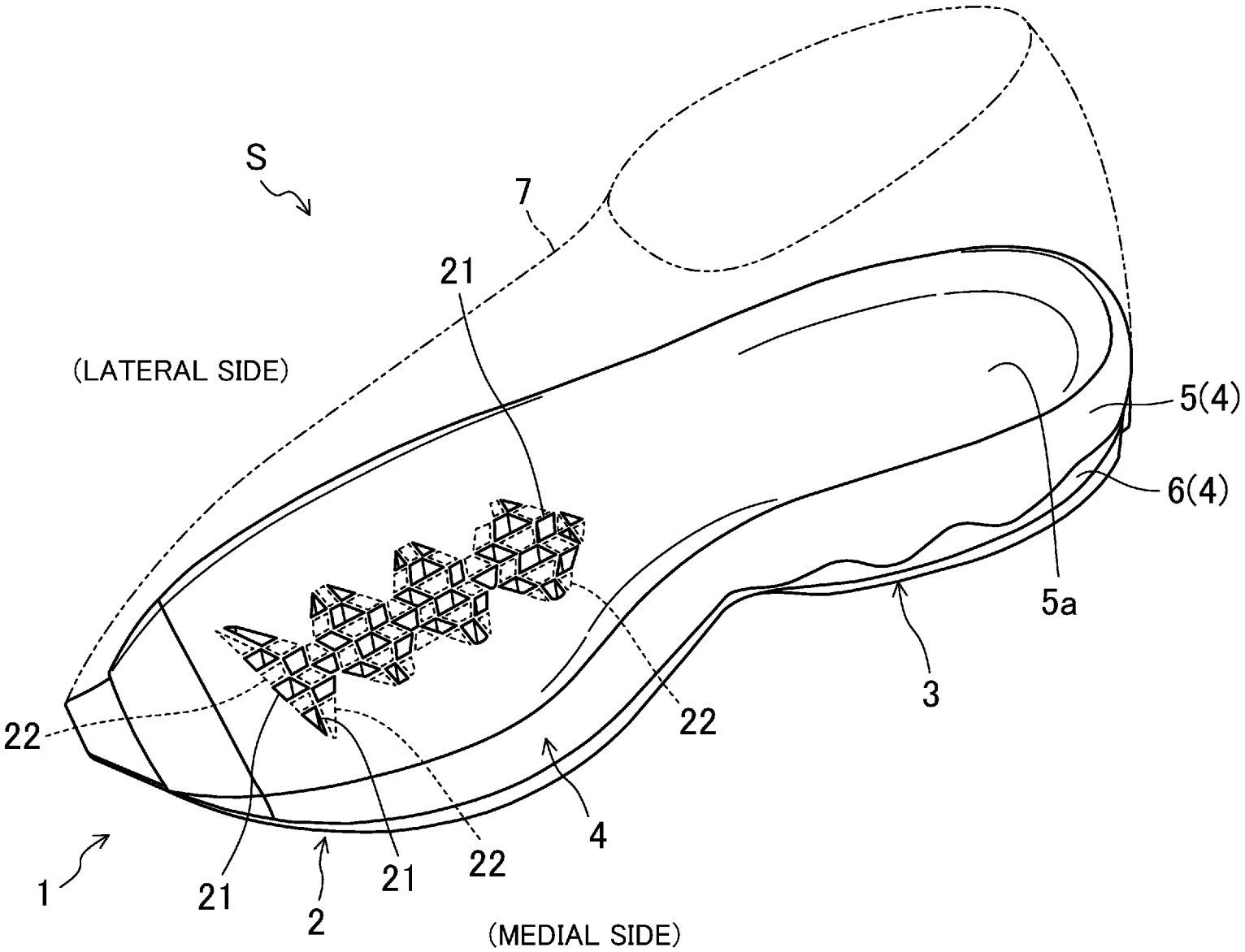
FIG. 1 is a perspective view illustrating an overall configuration of a sole structure according to an embodiment of the present disclosure and a shoe including the sole structure.

FIG. 1 is an overall view of a sole structure 1 according to an embodiment of the present disclosure. A pair of shoes S including the sole structure 1 may be used, for example, as athletic shoes for running and various sports, sneakers for daily use, or rehabilitation shoes.

The drawings show the sole structure 1 for a right shoe only. A sole structure for a left shoe is symmetrical to the sole structure 1 for the right shoe. In the following description, only the sole structure 1 for the right shoe will be described and the description of the sole structure for the left shoe will be omitted.

In the following description, the expressions "above," "upward," "on a/the top of," "below," "under," and "downward," represent the vertical positional relationship between components of the sole structure 1. The expressions "front," "fore," "forward, "rear," "back," "hind," "behind," and "backward" represent the positional relationship in the longitudinal direction between components of the sole structure 1. Further, a "medial side" and a "lateral side" represent the positional relationship of the sole structure 1 in the foot width direction.

(Sole Body)

As illustrated in FIGS. 1 to 4, the sole structure 1 includes a sole body 2 made of an elastic material. The sole body 2 includes an outsole 3 and a midsole 4.

Figure 3:
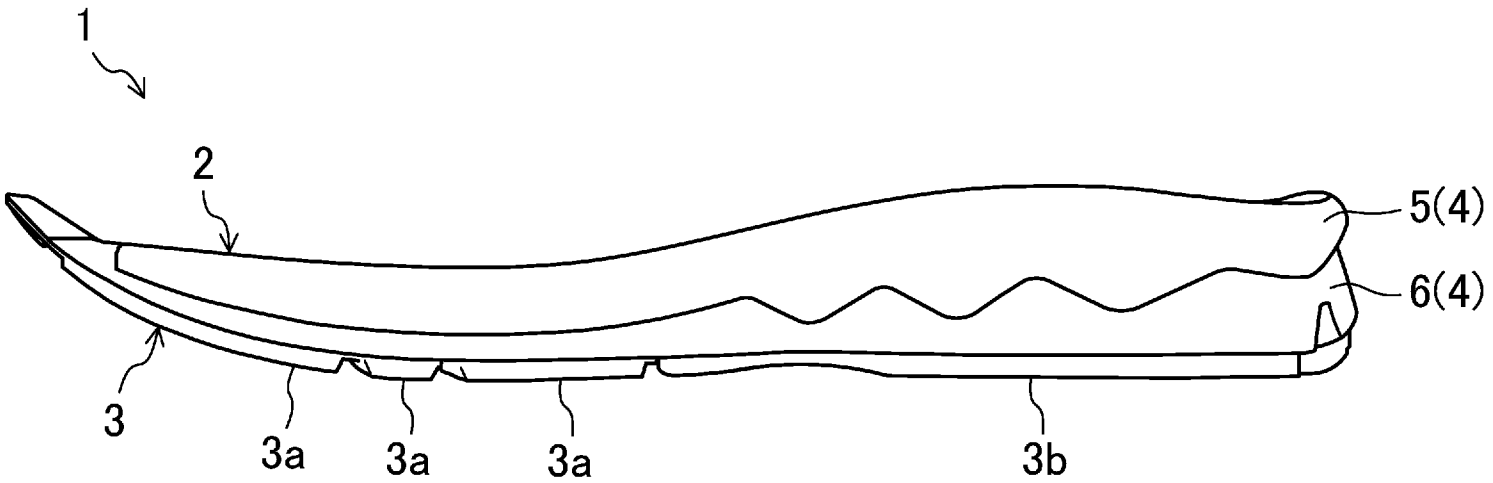
FIG. 3 is a side view of the sole structure, as viewed from a medial side.
Figure 4:
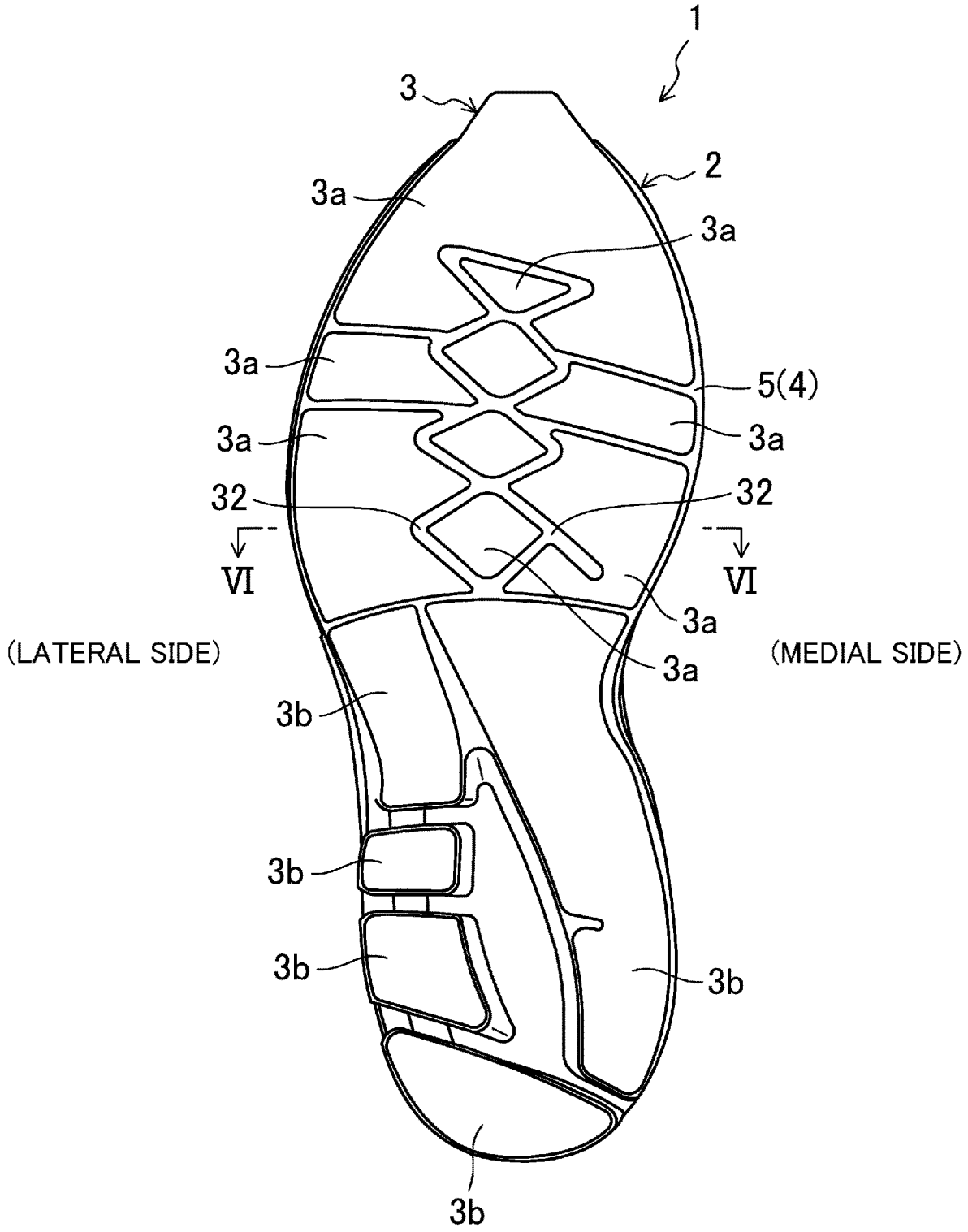
FIG. 4 is a bottom view of the sole structure.

As illustrated in FIGS. 3 and 4, the outsole 3 corresponds to a region of a foot of a wearer, the region extending from a forefoot to a hindfoot. The outsole 3 is made of a hard elastic material which is harder than the material for the midsole 4. Examples of materials suitable for the outsole 3 include, but not are limited to, thermoplastic resins such as ethylene-vinyl acetate copolymer (EVA), thermosetting resins such as polyurethane (PU), and rubber materials such as butadiene rubber and chloroprene rubber.

The outsole 3 is composed of a fore outsole 3*a*, 3*a*, . . . which support a region of the wearer's foot extending from the forefoot to a fore portion of the midfoot, and a hind outsole 3*b*, 3*b*, . . . which support a region of the wearer's foot extending from a hind portion of the midfoot to the hindfoot. The fore outsole 3*a* are arranged where transformable portions 32 are not present. The transformable portions 32 will be described later.

As illustrated in FIGS. 1 to 4, the midsole 4 is configured to support the entire planta of the wearer's foot. The midsole 4 is made of a soft elastic material. Examples of the material suitable for the midsole 4 include, but are not limited to, thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials.

The midsole 4 is stacked over the upper side of the outsole 3. A shoe upper 7 which covers the wearer's foot is attached to a peripheral portion of the midsole 4 (see phantom lines in FIG. 1).

The midsole 4 is divided in the vertical direction. Specifically, the midsole 4 has an upper midsole 5, and a lower midsole 6 stacked below the upper midsole 5. A planta support surface 5*a* configured to support the entire planta of the wearer's foot is formed on the upper surface of the upper midsole 5. Note the lower midsole 6 is stacked on the upper side of the outsole 3 by, for example, spraying PU. This is to spray polyurethane (PU) onto a mold (not shown) by means of a spray so that a sole is stacked without a defect in a corner portion of the mold or a thin portion of the sole.

Figure 6:
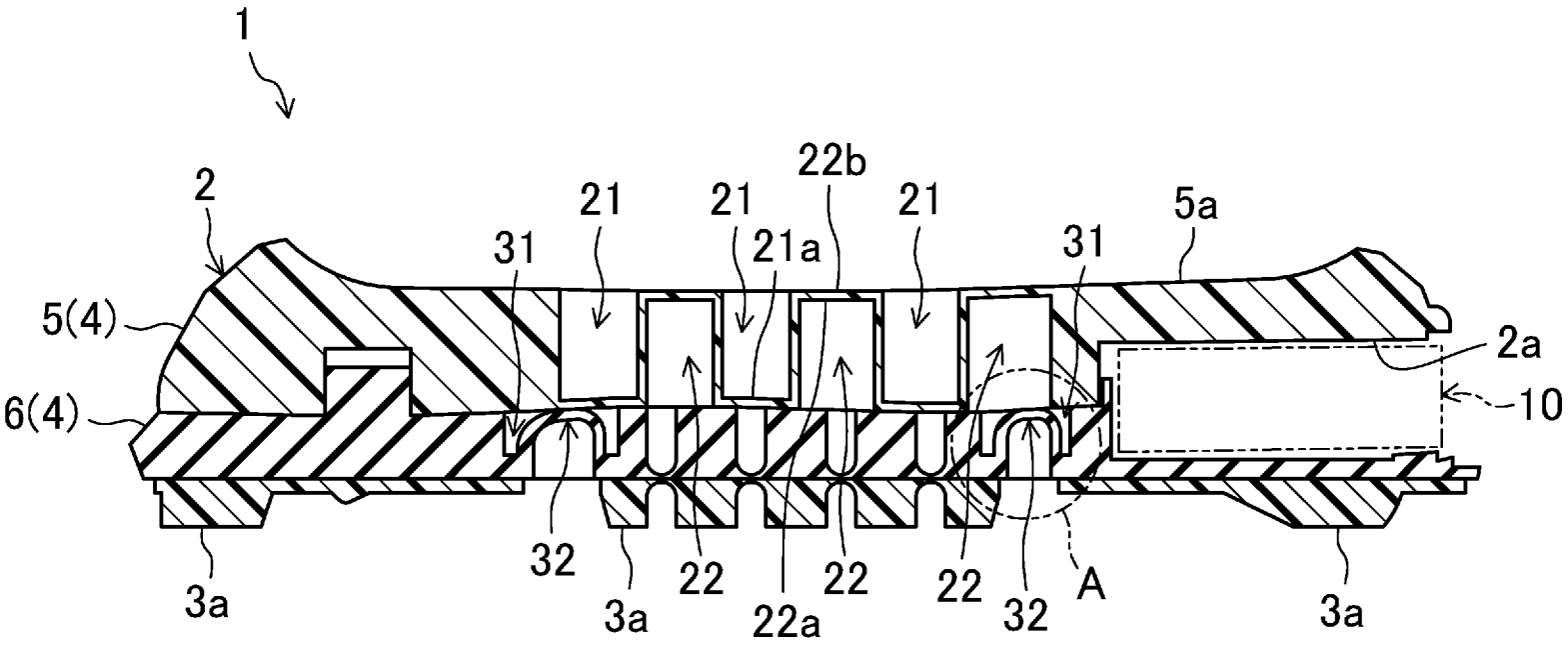
FIG. 6 is a cross-sectional view taken along line VI-VI in FIG. 4.

As illustrated in FIG. 6, the sole body 2 is provided with a housing 2*a* for housing an adjustment mechanism 10 at a position corresponding to the forefoot of the wearer's foot. The adjustment mechanism 10 will be described later. The housing 2*a* is formed as a space between the upper midsole 5 and the lower midsole 6. Note that FIG. 6 illustrates only part of the housing 2*a*, which is configured to house components of the adjustment mechanism 10, namely, a paddle 11, a body 13, and a first anchor 14, which will be described later.

(Adjustment Mechanism)

Figure 2:
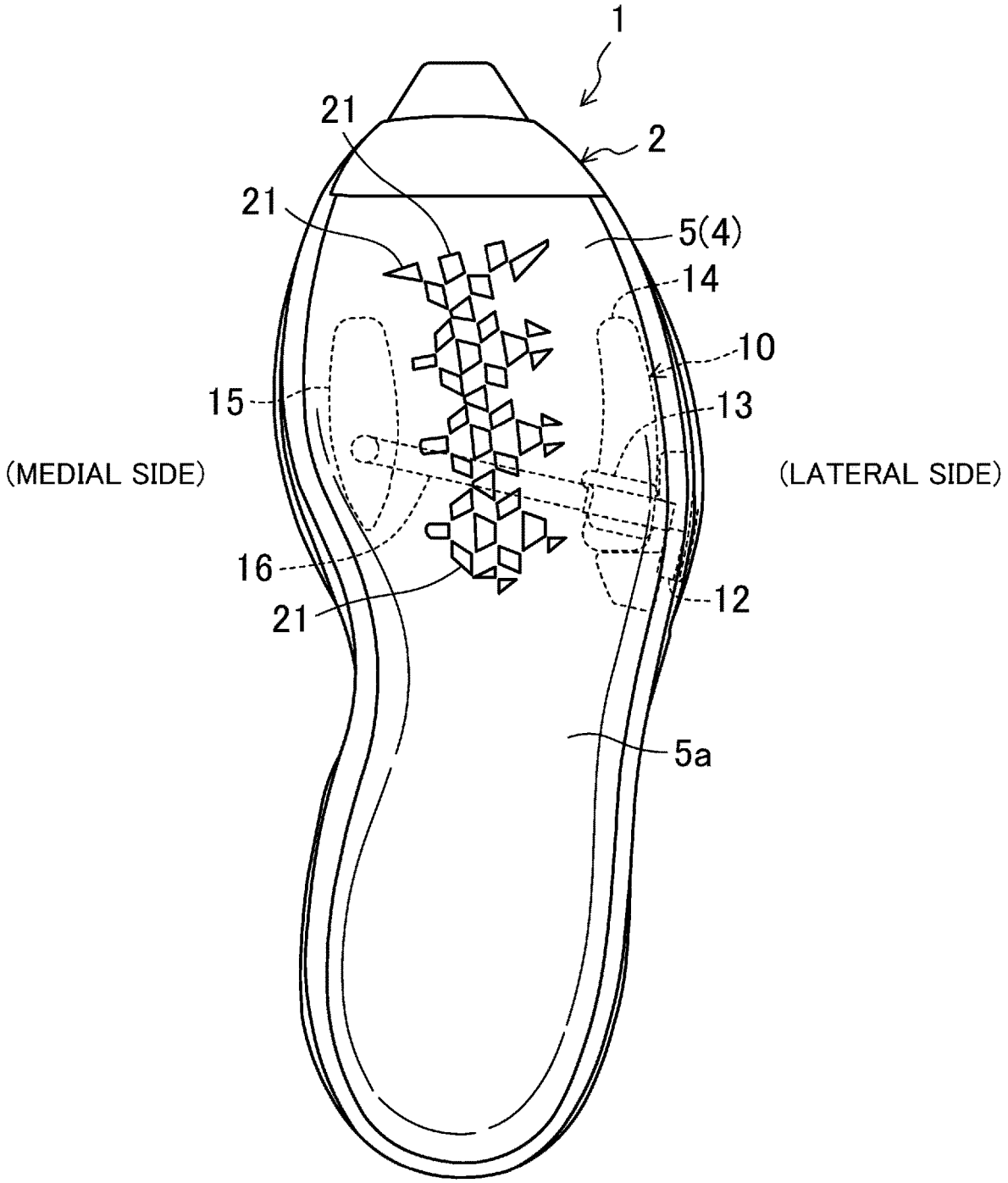
FIG. 2 is a top view of the sole structure.

Reference is now made to FIG. 2. As illustrated in FIG. 2, the adjustment mechanism 10 configured to adjust a length of the sole body 2 in the foot width direction is provided in an intermediate portion of the sole body 2 in the thickness direction. The adjustment mechanism 10 is housed in the housing 2*a* of the sole body 2. Specifically, the adjustment mechanism 10 is provided in the sole body 2 and positioned to correspond to the forefoot including metatarsophalangeal joints (hereinafter referred to as the MP joints) of the wearer's foot.

Figure 5:
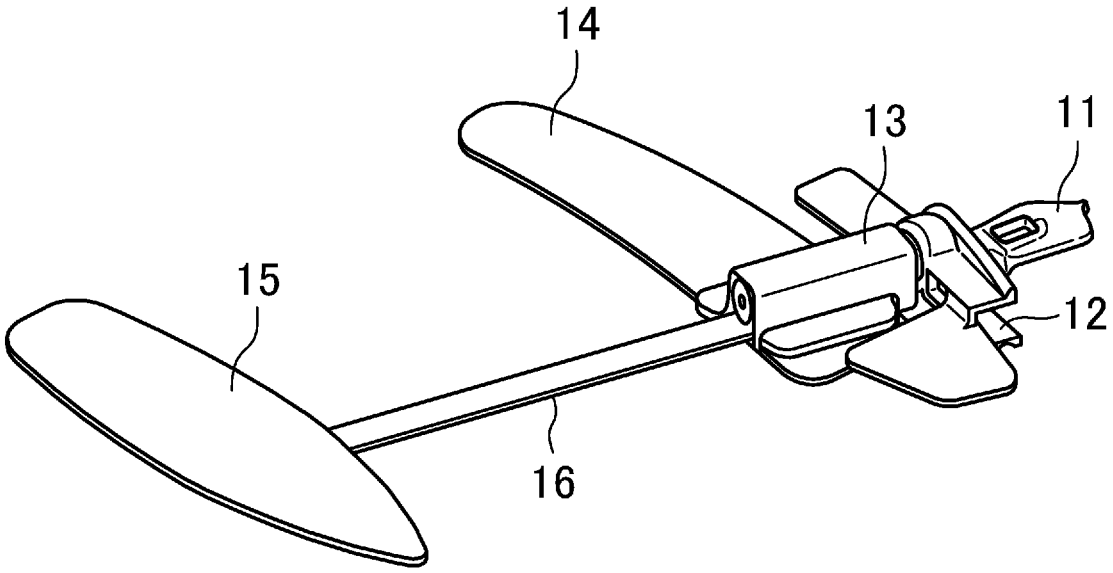
FIG. 5 is a perspective view illustrating an overall configuration of an adjustment mechanism.

As illustrated in FIG. 5, the adjustment mechanism 10 is comprised mainly of the paddle 11, a paddle housing 12, the body 13, the first anchor 14, a second anchor 15, and an actuation strap 16.

The paddle 11 is disposed at a position in the sole body 2, the position being adjacent to the lateral side. The paddle 11 is rotatably coupled to the body 13. As illustrated in FIG. 2, the paddle 11 is housed in the puddle housing 12. In this housed state, the paddle 11 is not rotatable with respect to the body 13. Specifically, in the housed state illustrated in FIG. 2, the length of the sole body 2 in the foot width direction is maintained at a predetermined length. In contrast, in a state illustrated in FIG. 5, the paddle 11 is exposed from the paddle housing 12 toward the lateral side of the sole body 2. In this state, the paddle 11 is rotatable with respect to the body 13.

The first anchor 14 is mounted to the lower side of the body 13 and is stationary with respect to the sole body 2. On the other hand, the second anchor 15 is disposed at a position, of the sole body 2, adjacent to the medial side. The second anchor 15 is movable in the foot width direction of the sole body 2.

The actuation strap 16 has a substantially rectangular shape and extends in the foot width direction. The actuation strap 16 has an end located adjacent to the lateral side and coupled to a lead screw (not shown) incorporated in the body 13, and an end located adjacent to the medial side coupled to the second anchor 15.

Described next is how the adjustment mechanism 10 operates. When the paddle 11 is rotated, the lead screw of the body 13 rotates. The rotation of the lead screw causes the actuation strap 16 to stretch and contract in the foot width direction. The stretch and contraction of the actuation strap 16 causes the second anchor 15 to move in the foot width direction. The length of the sole body 2 in the foot width direction can be adjusted through this sequential operation of the adjustment mechanism 10.

(Grooves and Transformable Portions)

As illustrated in FIG. 6, the lower midsole 6 is provided with grooves 31, 31 and transformable portions 32, 32. The grooves 31 and the transformable portions 32 are provided in an area, of the lower midsole 6, corresponding to the forefoot of the wearer's foot including the MP joints (see FIG. 4).

Figure 7:
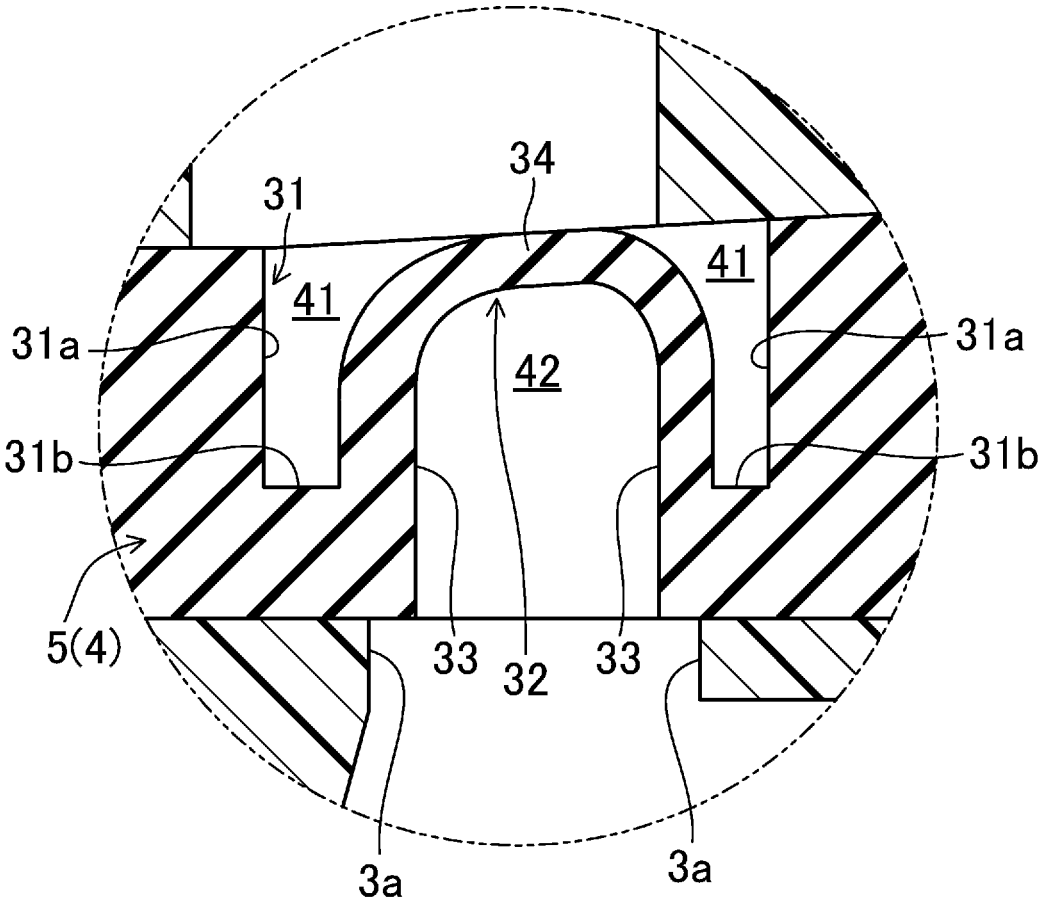
FIG. 7 is an enlarged partial view showing the portion A of FIG. 6.
Figure 8:
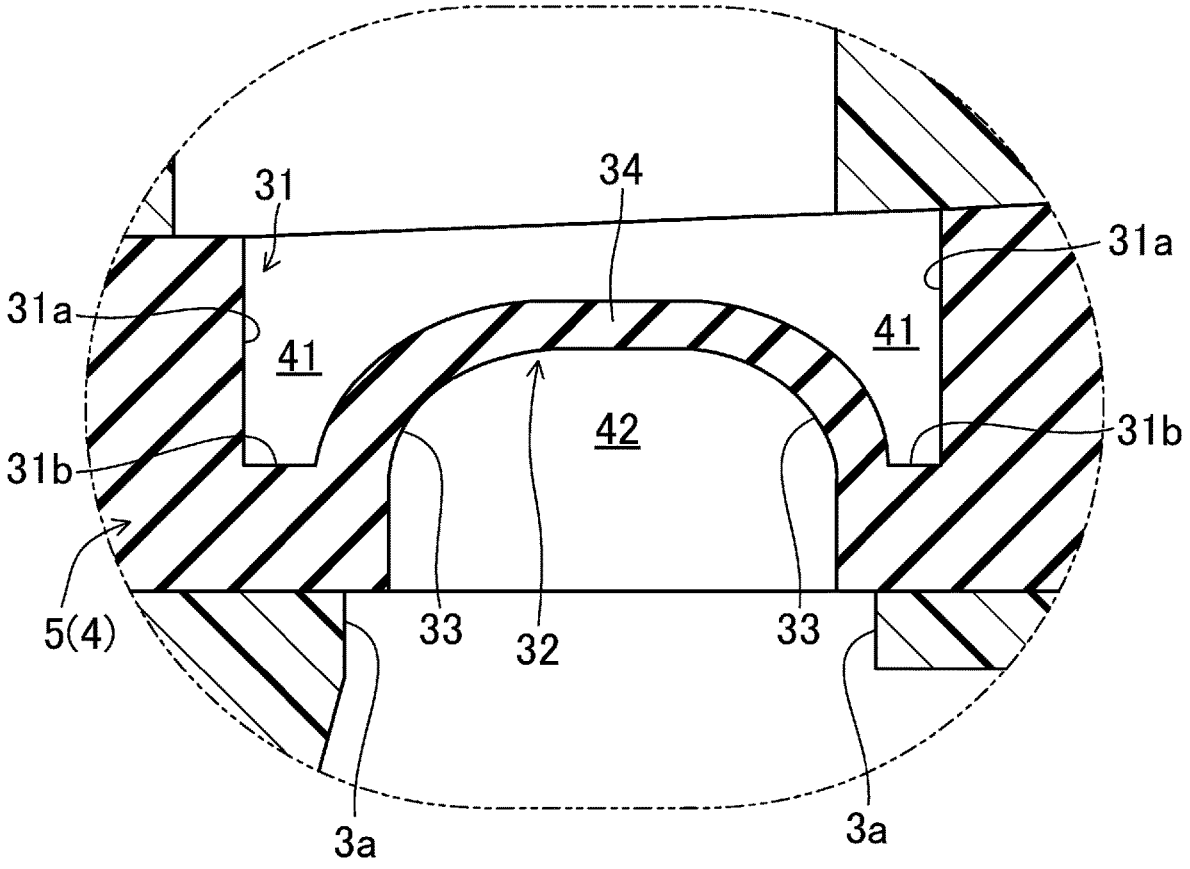
FIG. 8 corresponds to FIG. 7, and illustrates a state of a groove and a transformable portion when the length of a sole body in the foot width direction is increased with an adjustment mechanism.

As illustrated also in FIGS. 7 and 8, each groove 31 is recessed from the upper surface of the lower midsole 6 in a downward direction. The groove 31 is configured such that the inner wall surfaces 31*a*, 31*a* are made to come close to, and separate from, each other with the adjustment mechanism 10 in the foot width direction.

Each transformable portion 32 is disposed in an associated one of the grooves 31. The transformable portion 32, which extends between the inner wall surfaces 31*a*, 31*a* of the groove 31, is formed integrally with the lower midsole 6. The transformable portion 32 is loose when the inner wall surfaces 31*a*, 31*a* of the grooves 31 come close to each other (see FIGS. 6 and 7). Specifically, each transformable portion 32 has an inverted U-shape in cross-sectional view. The transformable portion 32 is elastically transformable and is configured to transform greater than stretch of the sole body 2 in the foot width direction caused with the adjustment mechanism 10.

Each transformable portion 32 has rising portions 33, 33. Each of the rising portions 33 is integrally formed with the groove 31 such that ends of the rising portion 33 located adjacent to the outsole 3 at one end are continuous with an inner wall surface 31*a* of the groove 31 via the bottom portion 31*b* of the groove 31. Beneficially, the rising portion 33 has a thickness of 1 mm to 2 mm.

The rising portions 33 extend in the vertical direction while the inner wall surfaces 31*a*, 31*a* of the groove 31 have come close to each other (see FIGS. 6 and 7). More specifically, the rising portions 33 extend upright from the bottom portion 31*b* of the groove 31.

Each transformable portion 32 has a coupling portion 34 for coupling the rising portions 33, 33 to each other at the other end. The coupling portion 34 is curved upward from the rising portions 33 at the other end. Specifically, the coupling portion 34 is formed such that the upper surface of the coupling portion 34 becomes coplanar with the upper surface of the lower midsole 6 in the state where the inner wall surfaces 31*a*, 31*a* of the groove 31 have come close to each other (see FIGS. 6 and 7). Beneficially, the coupling portion 34 has a thickness of 1 mm to 2 mm.

A first cavity 41 is provided between the inner wall surface 31*a* of the groove 31 and the rising portion 33. On the other hand, a second cavity 42 is provided between the rising portions 33, 33.

When the adjustment mechanism 10 causes the inner wall surfaces 31*a*, 31*a* of the groove 31 to come close to each other from the state where the inner wall surfaces 31*a*, 31*a* are separated away from each other (see FIG. 8), the transformable portion 32 is displaced toward the first cavity 41 (see FIG. 7). In contrast, when the adjustment mechanism 10 separate the inner wall surfaces 31*a*, 31*a* away from each other from the state where the inner wall surfaces 31*a*, 31*a* are close to each other (see FIG. 7, the transformable portion 32 is displaced toward the second cavity 42 (see FIG. 8. As a result, an excessive stress is less likely to concentrate at a root portion of the groove 31 and the transformable portion 32 when the length of the sole body 2 in the foot width direction is adjusted with the adjustment mechanism 10. This results in a decrease in a resistance generated in the sole body 2 by the adjustment mechanism 10 when the length of the sole body 2 in the foot width direction is adjusted, enabling smooth adjustment of the length of the sole body 2.

(First Recesses and Second Recesses)

As illustrated in FIG. 1, the upper midsole 5 of the sole body 2 has first recesses 21, 21, . . . and second recesses 22, 22, . . . The first and second recesses 21, 22 constitute a feature of the present disclosure. The first and second recesses 21, 22, are arranged in a region, of the upper midsole 5, corresponding to the forefoot of the wearer's foot including the MP joints. Note that for the sake of convenience, the second recesses 22, 22, . . . are omitted from the FIG. 2.

The first recesses 21, 21, . . . are arranged at intervals. Each first recess 21 is configured to have a micro opening in plan view. In this embodiment, each first recess 21 has the shape of a micro triangle or a micro quadrangle. Beneficially, the opening of each first recess 21 has an opening area of, for example, 100 $mm^2$ or smaller. Any shape having such a small opening can sufficiently provide advantages to be described later.

As illustrated in FIG. 6, each first recess 21 is recessed from the planta support surface 5*a* of the upper midsole 5 in the downward direction. In other words, each first recess 21 has a bottom 21*a* in its lower portion. On the other hand, each second recess 22 is recessed from the lower surface of the upper midsole 5 in the upward direction. In other words, each second recess 22 has a bottom 22*a* in its upper portion.

In the sole body 2, in a position where an adjustment mechanism 10 is not interposed between the upper and lower midsoles 5 and 6, the bottom 21*a* of each first recess 21 is in contact with the upper surface of the lower midsole 6. Each second recess 22 has a top surface 22*b* located across from the bottom 22*a* and coplanar with the planta support surface 5*a* of the upper midsole 5.

The first and second recesses 21, 22 are alternately and continuously formed in the foot width direction. In other words, the first and second recesses 21, 22 are formed to have a bellow structure which can be expanded and contracted in the foot width direction. Beneficially, each of the first and second recesses 21, 22 has a thickness of 1 mm to 2 mm.

(Advantages of Embodiment)

As can be seen from the foregoing, each of the first and second recesses 21, 22 is formed to have a bottom in the upper midsole 5 located above the adjustment mechanism 10. This feature makes it possible to reduce the risk of foreign objects coming from the outsole 3 toward the planta support surface 5*a* of the upper midsole 5. The first and second recesses 21, 22 alternately and continuously formed in the foot width direction. Such a structure allows the first and second recesses 21, 22 to easily expand and contract in the foot width direction. As a result, a resistance is less likely to be generated by the adjustment mechanism 10 at least in the upper midsole 5 when the length of the sole body 2 in the foot width direction is adjusted with the adjustment mechanism 10. Thus, the sole structure 1 can reduce the risk of foreign objects coming into the sole body 2, and allows smooth adjustment of the length of the sole body 2 in the foot width direction with the adjustment mechanism 10.

Each first recess 21 is configured to have a micro opening to the planta support surface 5*a*. Therefore, even if the first recesses 21, 21, . . . come into contact with planta of the wearer's foot, the wearer does not feel the presence of the first recesses 21, 21, . . . having the micro openings, reducing a local stimulus to the planta. Thus, the sole structure 1 can reduce discomfort to the planta of the wearer's foot.

First to Third Variations of Embodiment

Figure 9:
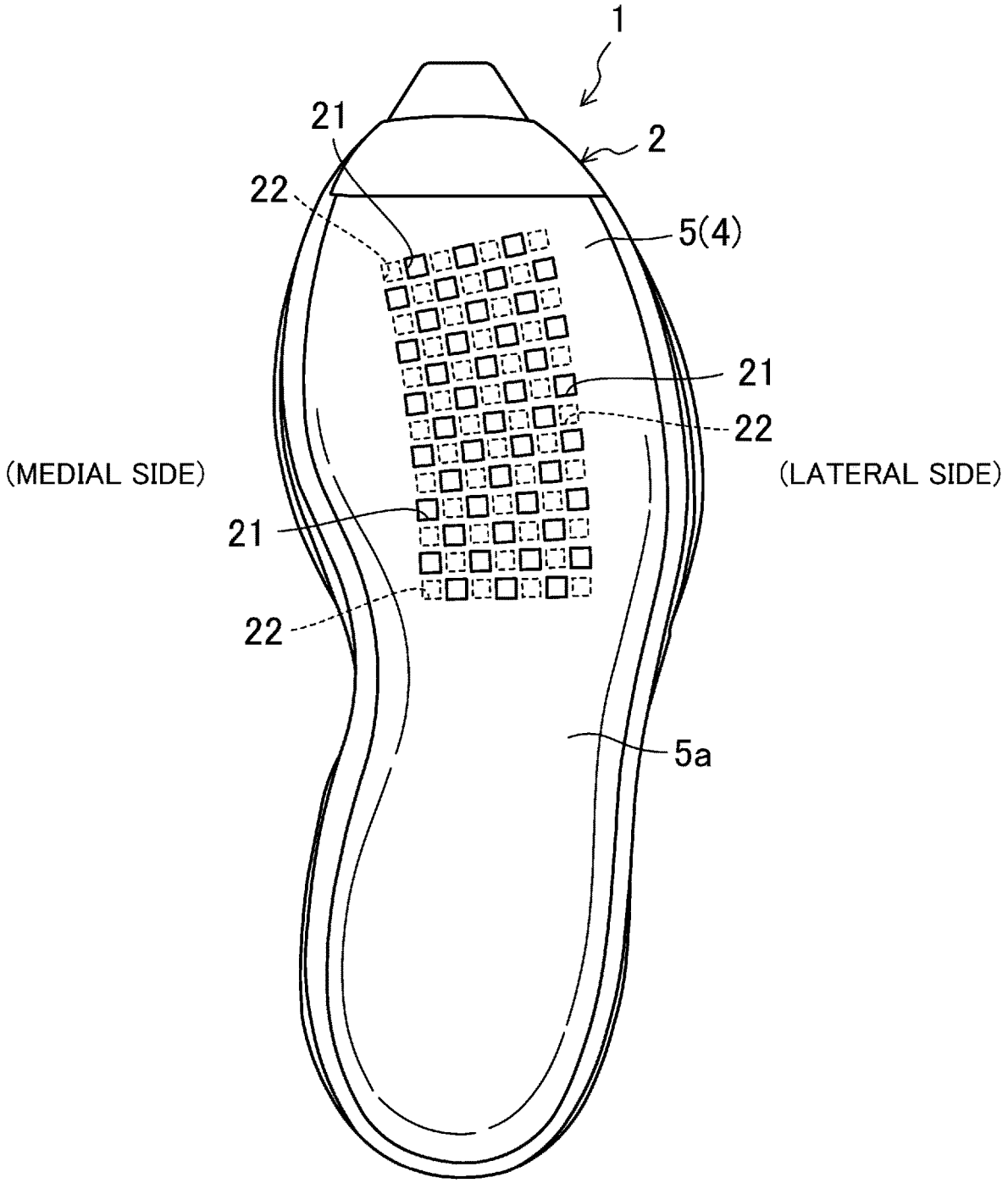
FIG. 9 is a plan view illustrating first and second recesses configured according to a first variation.
Figure 10:
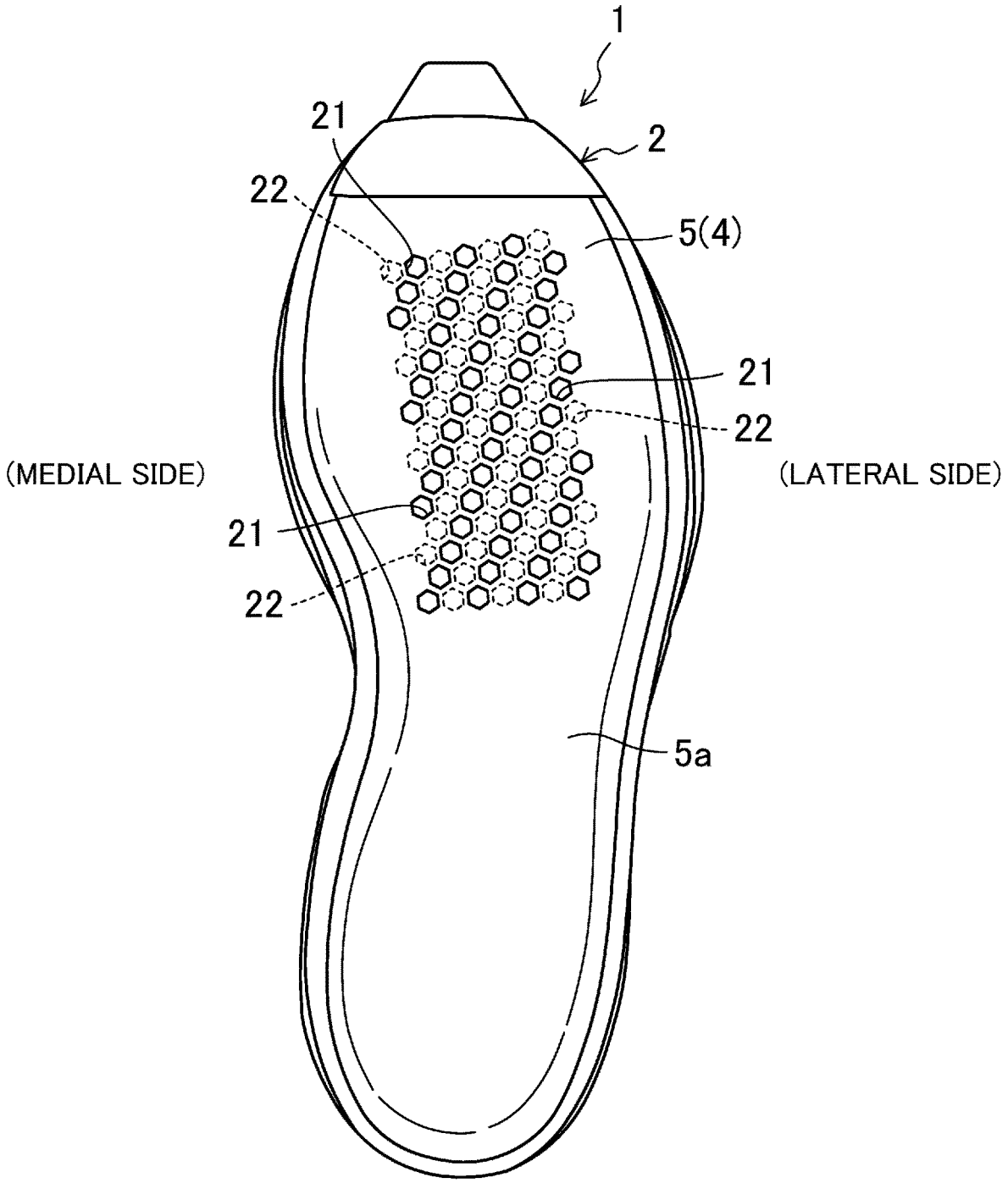
FIG. 10 corresponds to FIG. 9, and is a plan view illustrating first and second recesses configured according to a second variation.
Figure 11:
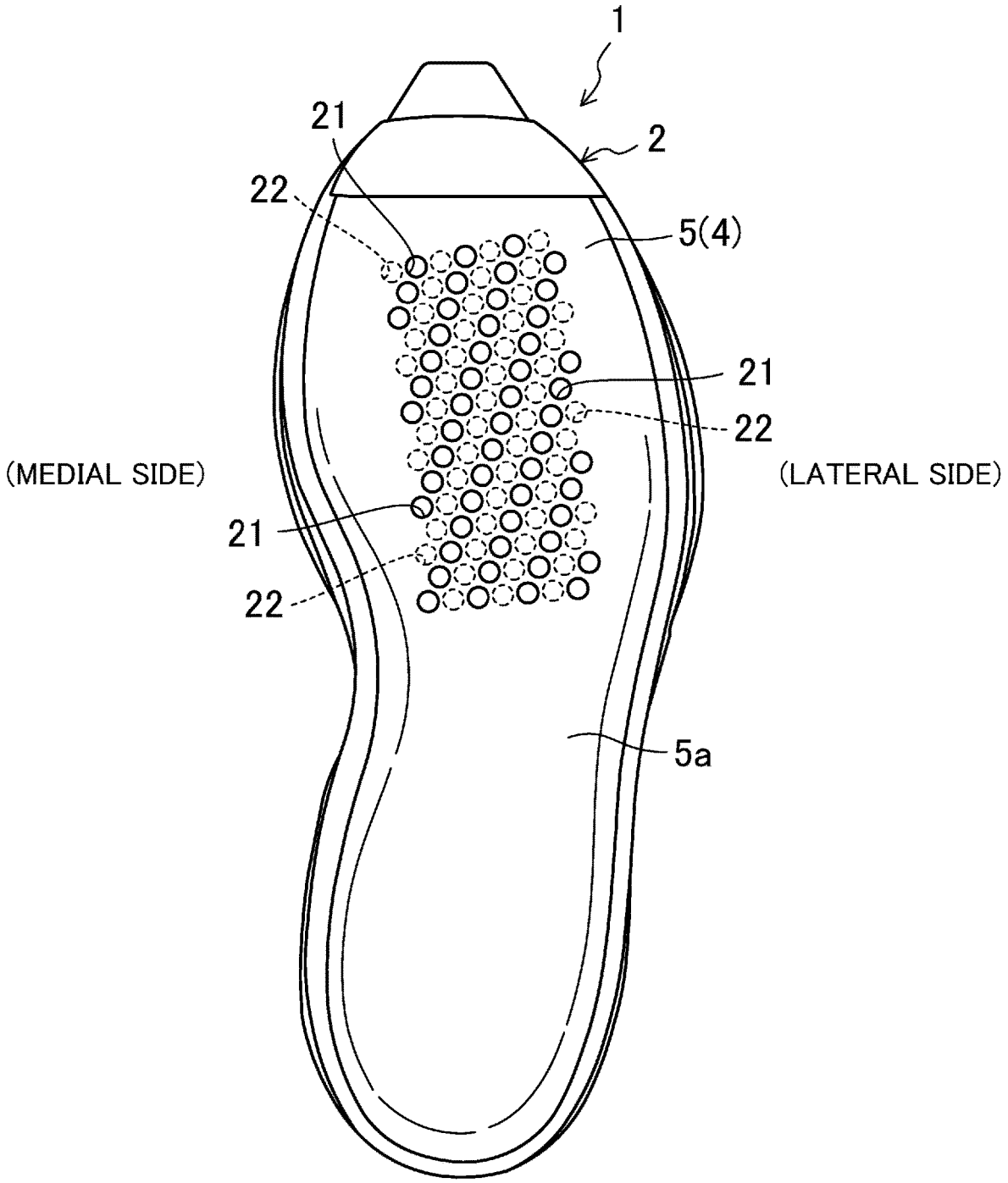
FIG. 11 corresponds to FIG. 9, and is a plan view illustrating first and second recesses configured according to a third variation.

In the embodiment described above, the opening of each first recess 21 is shaped into a micro triangle or a micro quadrangle. However, this is merely a non-limiting example. FIG. 9 illustrates a first variation as an example. As illustrated, the opening of each first recess 21 may be shaped into a square. Alternatively, as illustrated in a second variation in FIG. 10, the opening of each first recess 21 may be shaped into a hexagon. Alternatively, as illustrated in a third variation in FIG. 11, the opening of each first recess 21 may be shaped into a circle. Note that, each of the second recesses 22 has a downward opening in a shape similar to that of the first recess 21.

If the first and second recesses 21, 22 are alternately and continuously formed in the foot width direction in any one of the first to third variations, the resistance is less likely to be generated by the adjustment mechanism 10 as described in the above embodiment. Such a feature allows smooth adjustment of the length of the sole body 2 in the foot width direction with the adjustment mechanism 10. If each of the first recesses 21 has a micro opening in any one of the first to third variations, such a micro-sized opening can also reduce discomfort to the planta of the wearer's foot as described in the above embodiment.

Fourth Variation of Embodiment

Figure 12:
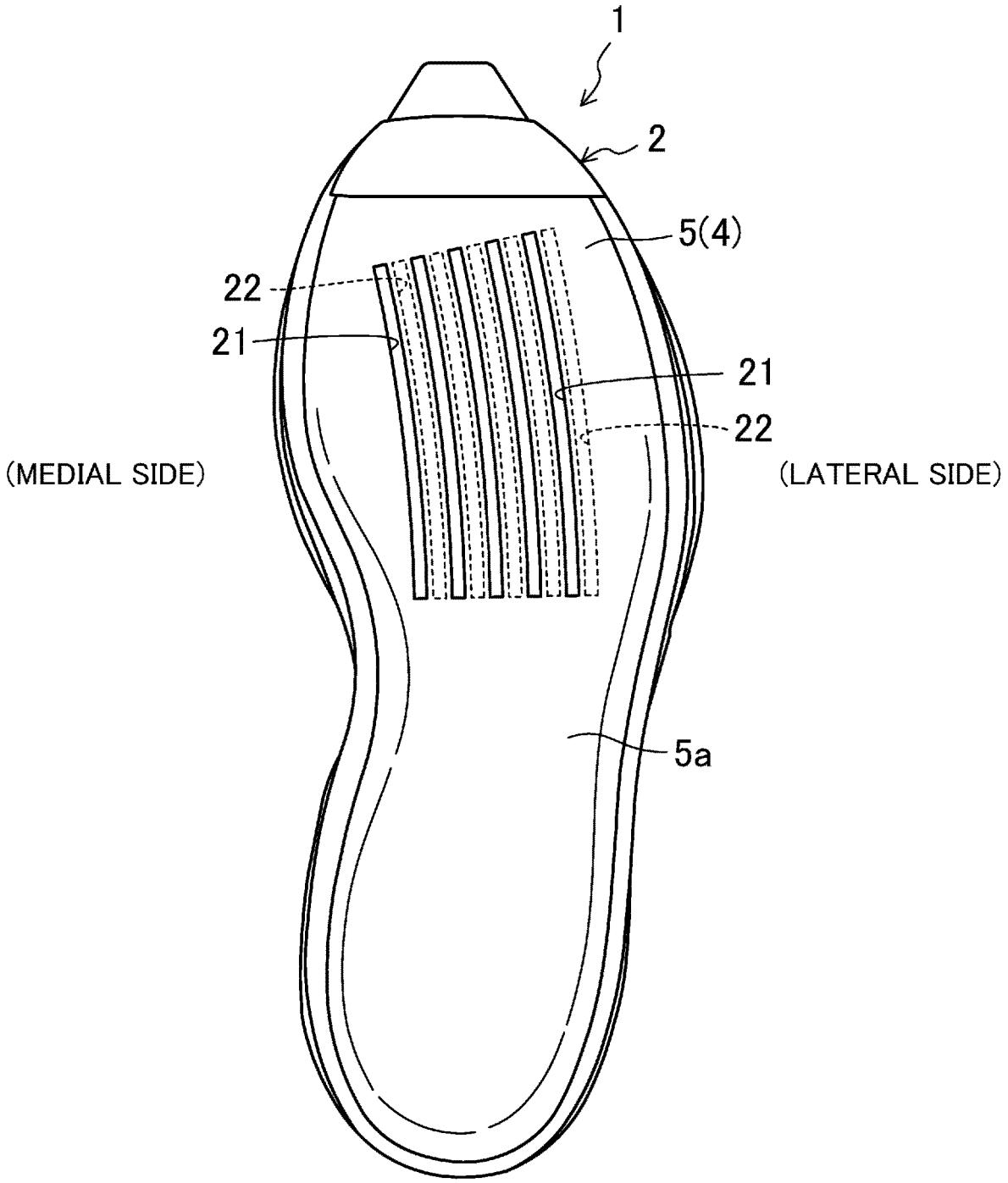
FIG. 12 corresponds to FIG. 9, and is a plan view illustrating first and second recesses configured according to a fourth variation.

FIG. 12 illustrates a fourth variation. As can be seen, each of the first recesses 21 may have an opening formed as a slot which extends in the longitudinal direction. A width of the slot in the foot width direction is shorter than a length thereof in the longitudinal direction. Note that, each of the second recesses 22 has a downward opening shaped in a similar manner to that of the first recess 21.

If the first and second recesses 21, 22 are alternately and continuously formed in the foot width direction in the fourth variation, the resistance is less likely to be generated by the adjustment mechanism 10 as described in the above embodiment. Such a feature allows smooth adjustment of the length of the sole body 2 in the foot width direction with the adjustment mechanism 10. If the opening of each first recess 21 is narrow in the foot width direction in the fourth variation, such an opening can also reduce discomfort to the planta of the wearer's foot.

Other Embodiments

In the above embodiment, the adjustment mechanism 10 is disposed at a position, in the sole body 2, corresponding to the forefoot of the wearer's foot. However, this is merely a non-limiting example. For example, the adjustment mechanism 10 may be disposed at a position, in the sole body 2, corresponding to the midfoot of the wearer's foot. Alternatively, the adjustment mechanism 10 may be disposed at a position, in the sole body 2, corresponding to both the forefoot and the midfoot of the wearer's foot. In these embodiments, the first recesses 21, the second recesses 22, the grooves 31, and the transformable portions 32 may suitably be disposed to correspond to the position of the adjustment mechanism 10.

The embodiment described above includes the grooves 31 and the transformable portions 32 provided in the lower midsole 6. However, this is merely a non-limiting example. For example, elements or components similar to the grooves 31 and the transformable portions 32 may be provided in the outsole 3. This configuration can also provide the same advantages as provided by the embodiment described above.

In the embodiment above, the transformable portions 32 are formed integrally with the grooves 31 of the lower midsole 6. However, this is merely a non-limiting example. Each transformable portion 32 may be provided as a separate member and may be fixed to the groove 31 of the lower midsole 6.

In the embodiment described above, the transformable portion 32 had an inverted U-shape. However, this is merely a non-limiting example. The transformable portion 32 may have a shape chosen from various shapes. For example, the transformable portion 32 may have an inverted V-shape. Alternatively, the transformable portion 32 may have a U-shape or a V-shape.

In the embodiment described above, the first and second recesses 21, 22 are provided only in the upper midsole 5. However, this is merely a non-limiting example. The first and second recesses 21, 22 may be provided in both the upper midsole 5 and the lower midsole 6.

Note that the present disclosure is not limited to the embodiments described above, and various changes and modifications may be made without departing from the scope of the present disclosure.

The present disclosure is industrially usable as a sole structure of, for example, athletic shoes, and as shoes including the sole structure.

What is claimed is:

1. A sole structure for a shoe, the sole structure comprising:

a sole body; and an adjustment mechanism provided in an intermediate portion of the sole body in a thickness direction, and capable of adjusting a length of the sole body in a foot width direction, wherein the sole body includes:

an outsole;

a lower midsole made of an elastic material and stacked above the outsole; and an upper midsole made of an elastic material, staked above the lower midsole, and having, on an upper surface thereof, a planta support surface supporting a planta of a wearer, the upper midsole includes:

a first recess recessed from the planta support surface in a downward direction and having a bottom, and a second recess recessed from a lower surface of the upper midsole toward the planta support surface, and having a bottom, and the first and second recesses are alternately and continuously formed in the foot width direction.

2. The sole structure of claim 1, wherein the first recess has a micro opening to the planta support surface.

3. A shoe comprising the sole structure of claim 1.

4. A shoe comprising the sole structure of claim 2.

* * * * *